US010408571B2

(12) United States Patent
Nobes et al.

(10) Patent No.: US 10,408,571 B2
(45) Date of Patent: Sep. 10, 2019

(54) SWITCH ASSEMBLY FOR OPTICAL SIGHT ACTIVATION

(71) Applicant: Raytheon Canada Limited, Ottawa (CA)

(72) Inventors: Ryan Walter Nobes, New Lowell (CA); Kevin Burgess Wagner, Wyevale (CA)

(73) Assignee: RAYTHEON CANADA LIMITED, Ottawa (CA)

( * ) Notice: Subject to any disclaimer, the term of this patent is extended or adjusted under 35 U.S.C. 154(b) by 1057 days.

(21) Appl. No.: 14/614,972

(22) Filed: Feb. 5, 2015

(65) Prior Publication Data

US 2019/0244771 A1 Aug. 8, 2019

(51) Int. Cl.

| | |
|---|---|
| ***F41G 1/38*** | (2006.01) |
| ***F41G 3/06*** | (2006.01) |
| ***F41G 1/387*** | (2006.01) |
| ***F41G 11/00*** | (2006.01) |

(52) U.S. Cl.

CPC ..... *F41G 1/38* (2013.01); *F41G 1/387* (2013.01); *F41G 3/06* (2013.01); *F41G 11/001* (2013.01)

(58) Field of Classification Search

CPC ... F41G 1/38; F41G 1/387; F41G 1/30; F41G 11/001; F41C 27/00; G02B 23/00

See application file for complete search history.

(56) References Cited

U.S. PATENT DOCUMENTS

| | | | | |
|---|---|---|---|---|
| 731,712 A | | 6/1903 | Schlaegel | |
| 1,044,658 A | | 11/1912 | Ide | |
| 1,051,485 A | | 1/1913 | Cale | |
| 2,134,406 A | * | 10/1938 | Jacobs | F41A 17/00 362/110 |
| 3,427,102 A | * | 2/1969 | Wade | F41A 33/00 352/179 |
| 3,914,873 A | | 10/1975 | Elliott, Jr. et al. | |
| 4,141,166 A | | 2/1979 | Schultz | |
| 4,627,183 A | | 12/1986 | Stuckman | |
| 4,835,621 A | * | 5/1989 | Black | F41J 5/10 352/95 |
| 4,856,218 A | | 8/1989 | Reynolds, Jr. | |
| 4,940,324 A | * | 7/1990 | Nichols | F41G 1/30 356/247 |

(Continued)

FOREIGN PATENT DOCUMENTS

| | | |
|---|---|---|
| EP | 0176169 A2 | 4/1986 |
| WO | 2010053436 A1 | 5/2010 |

OTHER PUBLICATIONS

International Search Report and Written Opinion; International Application No. PCT/US2015/063725; International Filing Date: Dec. 3, 2015; dated Feb. 16, 2016; 14 pages.

(Continued)

*Primary Examiner* — Benjamin P Lee

(74) *Attorney, Agent, or Firm* — Cantor Colburn LLP

(57) ABSTRACT

A switch assembly is provided for optical sight activation. The switch assembly includes a shoulder mounted device comprising an actuatable portion and a stock, an electrically powered optical sight disposable on the shoulder mounted device in alignment with the actuatable portion, a switch disposed in the stock and actuatable to activate operations of the optical sight and circuitry by which the optical sight and the switch are electrically coupled.

18 Claims, 4 Drawing Sheets

(56) References Cited

U.S. PATENT DOCUMENTS 5,064,988 A * 11/1991 E'nama ..... F41G 1/35 219/121.6
5,065,538 A 11/1991 Allen
5,237,773 A 8/1993 Claridge
5,528,847 A 6/1996 Fisher
5,590,486 A * 1/1997 Moore ..... F41G 1/35 362/110
5,621,999 A * 4/1997 Moore ..... F41G 1/35 362/110
6,226,880 B1 * 5/2001 Pitre ..... F41G 1/38 42/120
6,230,431 B1 * 5/2001 Bear ..... F41G 1/35 362/114
7,246,461 B2 * 7/2007 Wooden ..... F41G 1/44 359/422
7,490,430 B2 2/2009 Staley, III
7,644,530 B2 1/2010 Scherpf
8,555,541 B2 10/2013 Ingram
2007/0214700 A1 * 9/2007 Chang ..... F41G 1/32 42/119
2012/0000979 A1 * 1/2012 Horvath ..... F41G 1/38 235/407
2013/0152445 A1 6/2013 Compton
2016/0069640 A1 * 3/2016 Pretorius ..... F41G 3/065 42/122
2016/0069644 A1 * 3/2016 Bell ..... F41G 11/001 89/204
2017/0038177 A1 * 2/2017 Sun ..... F41G 1/30
2017/0155269 A1 * 6/2017 Swift ..... H02J 50/12

OTHER PUBLICATIONS

OA Issued Nov. 2, 2018 in RAY0292EP, EP Application No. 15817000.1, 6 pages.

* cited by examiner

SWITCH ASSEMBLY FOR OPTICAL SIGHT ACTIVATION

BACKGROUND

The present invention relates to a switch assembly and, more particularly, to a switch assembly for use with optical sight activation.

A sight is a device used to assist in aligning or aiming weapons, surveying instruments or other items by eyesight. Sights can be a simple set or system of markers that have to be aligned together as well as aligned with the target (referred to as an iron sights on firearms). They can also be optical devices that allow the user to see the image of an aligned aiming point in the same focus as the target. These include telescopic sights and reflector (or "reflex") sights. There are also sights that project an aiming point onto the target itself, such as laser sights.

At its simplest, a sight is typically composed of front and rear aiming pieces that have to be lined up. Increasingly advanced sights employ multiple lenses that magnify a target and include cross hairs that allow the target to be aimed at. Still further advances have come in the form electrically powered sight components, such as optical enhancements to sights whereby the target can be illuminated or painted with a laser. Such electrically powered components require a power source, however, which has a limited amount of available power that is diminished by unnecessary power usage by the electrically powered components during otherwise non-operational periods.

SUMMARY

According to one embodiment of the present invention, a switch assembly is provided for optical sight activation. The switch assembly includes a shoulder mounted device comprising an actuatable portion and a stock, an electrically powered optical sight disposable on the shoulder mounted device in alignment with the actuatable portion, a switch disposed in the stock and actuatable to activate operations of the optical sight and circuitry by which the optical sight and the switch are electrically coupled.

According to another embodiment, a switch assembly is provided for optical sight activation. The switch assembly includes a shoulder mounted device that includes an actuatable portion and a stock integrally coupled to a rear of the actuatable portion, an electrically powered optical sight disposable on the shoulder mounted device in alignment with the actuatable portion, the optical sight being normally operable in a first mode and selectively operable in a second mode during which the optical sight uses more electricity than in the first mode and a switch disposed in the stock, the switch being coupled to the optical sight and actuatable to cause the optical sight to operate in the second mode.

According to yet another embodiment, a switch assembly is provided for optical sight activation. The switch assembly includes a shoulder mounted device comprising an actuatable portion and a stock, which is formed to define a recess and a channel, integrally coupled to a rear of the actuatable portion, an electrically powered optical sight disposable on the shoulder mounted device in alignment with the actuatable portion, the optical sight being normally operable in a sleep mode and selectively operable in an active mode, a switch disposed in the recess of the stock and circuitry running through the channel of the stock by which the switch and the optical sight are electrically coupled. The switch is actuatable to cause the optical sight to operate in the second mode.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
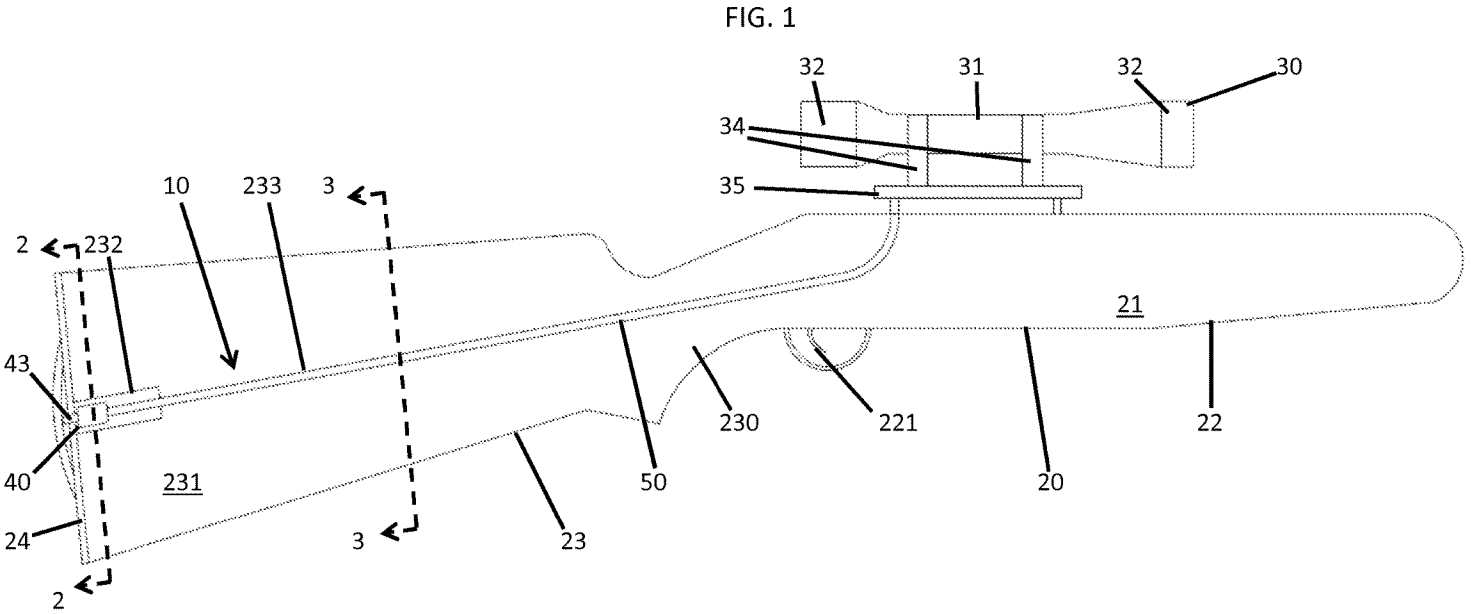
FIG. 1 is a side view of a sight mount and a switch of a rifle in accordance with embodiments.

In battery operated rifle sights used for weapons, such as rifles, the sights are normally powered at all times during field use, but as they may be carried by users they may not often be in a position to be fired. As will be described below, however, the battery life of the sights can be increased by only powering the sights when the rifles are pressed against the shoulders of the users. A switch inside the stock of the rifles activates the sight and may, in one embodiment, be a mechanical switch that completely disconnects the battery from the sight. In another embodiment, the switch may be electronic, such as a Hall Effect switch with a magnet in the butt plate, to activate the switch. For systems that are not able to completely shut down, the switch can place the sights in a sleep mode for fast on times to ensure the sights are fully operational in time for use. A channel for the wires would run through the stocks to the optical rails of the rifles or along an exterior of the stocks.

With reference to FIGS. 1-3 and FIGS. 4 and 5, a switch assembly 10 is provided for optical sight activation. The switch assembly includes a shoulder mounted device 20, an electrically powered optical sight 30, a switch 40 and circuitry 50. The shoulder mounted device 20 may be provided as a sighting instrument or a shoulder mounted weapon, such as a rifle 21. For the purposes of clarity and brevity, the following description will relate to the case where the shoulder mounted device 20 is the rifle 21 although it is to be understood that this embodiment is merely exemplary.

In the exemplary embodiment of the rifle 21, the shoulder mounted device 20 includes an actuatable portion 22 and a stock 23. The actuatable portion 22 has a barrel that extends along a longitudinal axis and a firing mechanism. The stock 23 is integrally coupled to a rear of the actuatable portion 22 and has a handle 230 and a shoulder abutment portion 231. The handle 230 is formed to be gripped by a hand of a user so that the use can activate the firing mechanism 221 and the shoulder abutment portion 231 has an increasing thickness in the rearward direction from the handle 230. An end of the shoulder abutment portion 231 is disposed to abut against the shoulder of the user when the rifle 21 is in an operational condition so that the user can look through the optical sight 30 for aiming purposes. The end of the shoulder abutment portion 231 thus has a generally flat butt plate 24.

Figure 3:
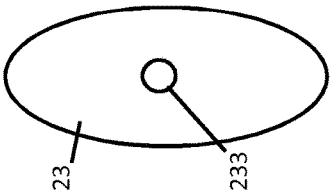
FIG. 3 is an axial view of the stock of the rifle of FIG. 1 taken along line 3-3.
Figure 2:
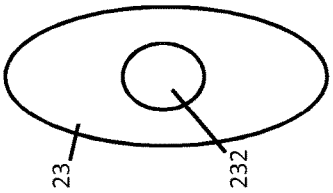
FIG. 2 is an axial view of a stock of the rifle of FIG. 1 taken along line 2-2.

The stock 23 is formed to define a recess 232 and, in some cases, a channel 233. The recess 232 extends into a rear of the stock 23 from the butt plate 24 and, when defined, the channel 233 extends from an end of the recess 232 and through the stock and the handle 230 to terminate at an upper portion of the actuatable portion 22. As shown in FIG. 2, the recess 232 may have a height and a thickness that are less than the height and the thickness of the stock 23. As shown in FIG. 3, the channel 233 may have an annular (or angular) cross-section and may be generally positioned in a center of the stock 23.

The optical sight 30 is disposable on the shoulder mounted device 20 and extends along a longitudinal axis. The optical sight 30 includes an elongate body 31 that has first and second ends and a longitudinal axis and optical elements 32. The optical elements 32 may include lenses and are disposed in each of the first and second ends to magnify a sighted target. The optical elements 32 may further include additional aiming tools, such as cross-hairs, that can be aligned over the sighted target to aid in aiming. The optical sight 30 is further capable of electrically powered functionality, such as generation of a heads-up display, target illumination and night vision, and thus may further include optical enhancement elements 33 (see FIG. 4) that require electrical power.

As shown in FIG. 1, the optical sight 30 may be mounted in a sight mount 34 that is secured to a rail 35. The rail 32 is attached to an upper surface of the actuatable portion 22 such that the longitudinal axes of the actuatable portion 22 and the optical sight 30 are generally in an aligned condition. The sight mount 34 may include forward and rear sight mount elements that secure the first and second ends of the optical sight 30 to the rail 35. The rail 35 has multiple groves and lands defined thereon in which the forward and rear sight mount elements can sit such that the optical sight 30 can be moved forwardly or reversely relative to the actuatable portion 22 as desired.

Figure 4:
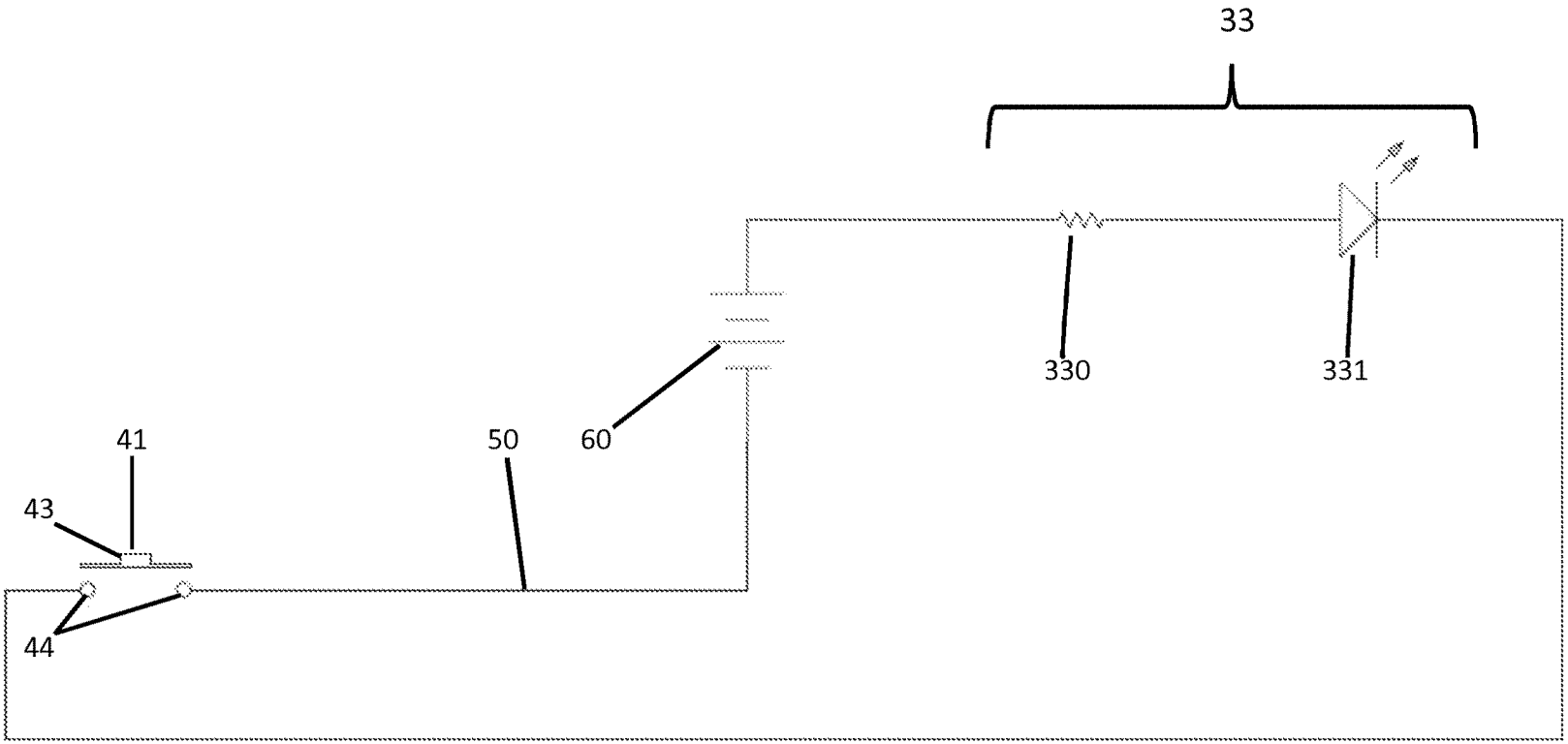
FIG. 4 is a schematic view of circuitry by which the sight mount and the switch of FIG. 1 are electrically coupled in accordance with embodiments.

In accordance with embodiments, the optical enhancement elements 33 may include various electronic devices, such as resistive elements 330 and light emitting diodes (LEDs) 331 (see FIG. 4). The electrical power for the optical enhancement elements 33 may be provided by a battery 60 that is included in the optical sight 30 itself, the rifle 21 or, as shown in FIG. 1, in the sight mount 34. In any case, electricity may be fed to the optical sight 30 by way of electrical leads that can be provided in the sight mount 34 or external to the sight mount 34. In accordance with embodiments, the battery 60 can be non-rechargeable or rechargeable.

Where the optical sight 30 is capable of electrically powered functionality, the optical sight 30 may be normally operable in a first mode and selectively operable in a second mode. In the first mode, the electronics in the optical sight 30 (i.e., the optical enhancement elements 33) are turned off or at least disposed in a sleep mode so that the optical sight 30 uses no or only limited electric power. By contrast, in the second mode, the electronics in the optical sight 30 are activated and thus the optical sight 30 uses more electricity than it does when operating in the first mode.

The switch 40 is disposed in the recess 232 of the stock 23 and is electrically coupled to the optical sight 30 by the circuitry 50. The circuitry 50 may be provided as wiring that runs from the switch 40 to the optical sight 30 along the stock 23 or, where applicable, through the channel 233. As the switch 40 is disposed in the recess 232, the switch 40 is actuatable by abutment with a user's shoulder. In this abutment condition, the switch 40 causes the optical sight 30 to operate in the second mode such that the electronics in the optical sight 30 are activated. However, when the abutment condition is not in effect, the switch 40 causes the optical sight 30 to revert back to operation in the first mode in order to save battery power and life.

In accordance with embodiments and, as shown in FIGS. 1 and 4, the switch 40 may include a mechanical switch 41. In this case, the switch 40 includes a flexible surface 42, a plunger 43 and leads 44. The plunger 43 is coupled to the flexible surface 42 and the flexible surface 42 is mounted on the butt plate 24. As such, when the rifle 21 is placed in the firing position, the user's shoulder abuts with the flexible surface 42 and thereby drives the plunger 43 toward the leads 44. Once the plunger 43 contacts the leads, the battery 60 is placed into serial electronic connection with the resistive elements 330 and the LEDs 331. The LEDs 331 thus emit light that enables certain optical enhancements of the target to be engaged.

Figure 5:
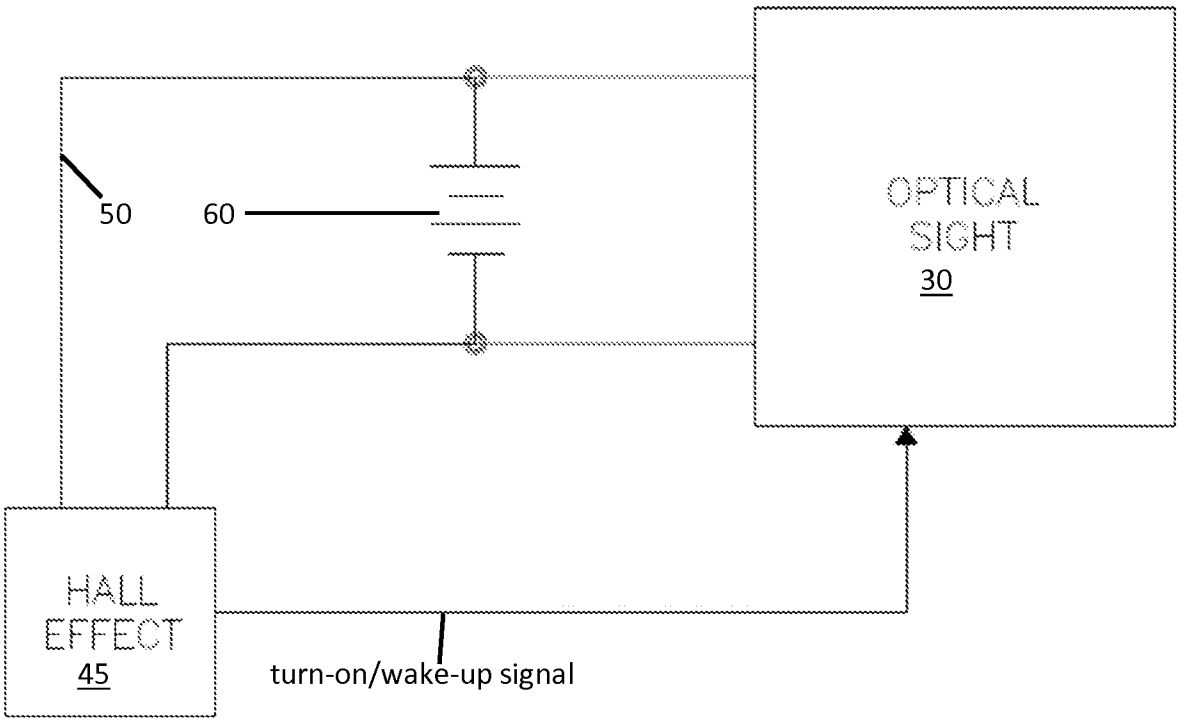
FIG. 5 is a schematic view of circuitry by which the sight mount and the switch of FIG. 1 are electrically coupled in accordance with alternative embodiments.

In accordance with alternative embodiments and, as shown in FIG. 5, the switch 40 may include a Hall Effect switch 45. In this case, the switch 40 includes a sensor and a magnetic element coupled to the flexible surface 42 (see FIG. 1). When the rifle 21 is placed in the firing position and the user's shoulder abuts with the flexible surface 42, the magnetic element is driven toward the sensor which then outputs a turn-on or wake-up signal to the optical sight 30. This turn-on/wake-up signal causes the optical sight 30 to activate and operate in the second mode.

Figure 6B:
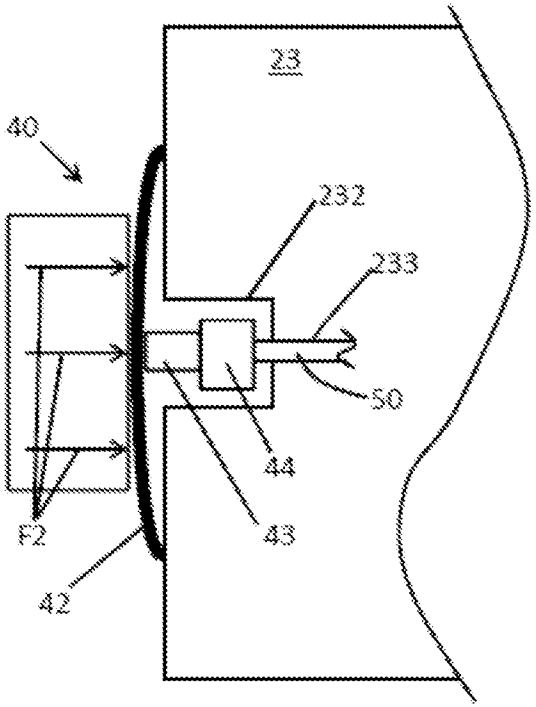
FIG. 6B is an enlarged side view of the switch of FIG. 6A in an actuated condition.
Figure 6A:
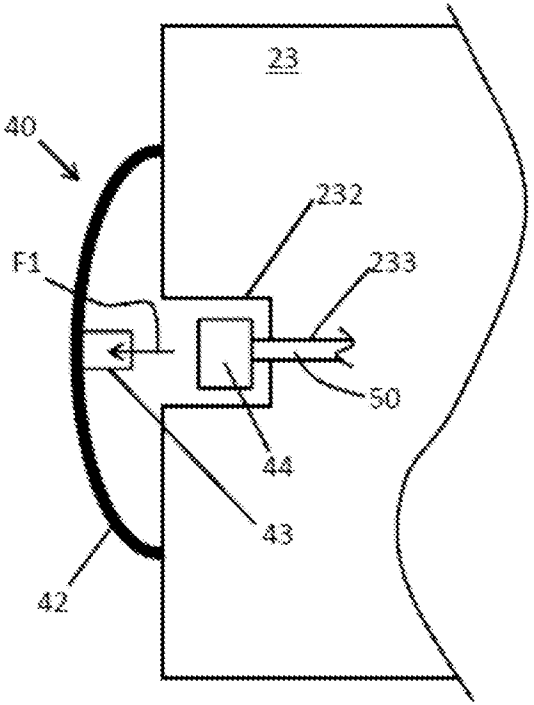
FIG. 6A is an enlarged side view of the switch of FIG. 1 in a non-actuated condition.

With reference to FIGS. 6A and 6B, an operation of the switch 40 is shown with an understanding that while the switch 40 is illustrated in FIGS. 6A and 6B as the mechanical switch 41 embodiment the operation of the switch 40 would be similar in the Hall Effect switch 45 embodiment.

As shown in FIG. 6A, the stock 23 is not placed in a firing position and is not engaged with or otherwise abutting the user's shoulder. In this condition, the flexible surface 42 has a bias that urges plunger 43 away from the leads 44 with a force F1. As such, the optical sight 30 is made to operate in the first mode (i.e., deactivated) in effective accordance with the condition of the switch 40. By contrast, however, the user's shoulder impinges against the flexible surface 42 when the stock 23 is placed in the firing position to thereby urge the plunger 43 toward the leads 44 with a force F2 that exceeds the force F1 as shown in FIG. 6B. In this case, the optical sight 30 is made to operate in the second mode (i.e., activated) in effective accordance with the condition of the switch 40. Subsequently, when the stock 23 is removed from the firing position, the bias of the flexible surface 42 causes the plunger 43 to recede from the leads 44 to return the optical sight 30 to operation in the first mode. Thus, it is seen that the normal operation of the optical sight 30 may be due at least in part to the bias applied to the plunger 43 by the flexible surface 42 and that this bias can only be overcome by the impingement of the user's shoulder on the flexible surface 42 to thereby initiate second mode operation of the optical sight 30.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The described embodiments were chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A switch assembly for optical sight activation, comprising:

a shoulder mounted device comprising an actuatable portion and a stock having a handle and a shoulder abutment portion;

an electrically powered optical sight disposable on and in alignment with the actuatable portion;

a switch disposed in the shoulder abutment portion of the stock, the switch being actuatable to activate operations of the optical sight; and circuitry which extends from the switch, through the shoulder abutment portion and the handle of the stock and through an upper portion of the actuatable portion and by which the optical sight and the switch are electrically coupled.

2. The switch assembly according to claim 1, wherein the shoulder mounted device comprises a rifle and the optical sight is coupled to a rail disposed on an upper surface of the upper portion of the actuatable portion.

3. The switch assembly according to claim 1, further comprising a battery to provide power to the electrically powered optical sight, wherein the optical sight comprises a resistive element and a light emitting diode (LED).

4. The switch assembly according to claim 1, wherein the switch comprises one of a mechanical switch and a Hall Effect sensor.

5. The switch assembly according to claim 1, wherein:

the switch is disposed in a recess defined in the stock, the circuitry runs through a channel defined through the shoulder abutment portion and the handle of the stock and through the upper portion of the actuatable portion, and the channel terminates in the upper portion of the actuatable portion.

6. The switch assembly according to claim 1, wherein the switch is actuated to turn the optical sight on.

7. The switch assembly according to claim 1, wherein the optical sight is configured to assume a sleep mode unless the switch is actuated.

8. A switch assembly for optical sight activation, comprising:

a shoulder mounted device comprising an actuatable portion and a stock integrally coupled to a rear of the actuatable portion and having a handle and a shoulder abutment portion;

an electrically powered optical sight disposable on and in alignment with the actuatable portion, the optical sight being normally operable in a first mode and selectively operable in a second mode during which the optical sight uses more electricity than in the first mode; and a switch disposed in the shoulder abutment portion of the stock, the switch being coupled to the optical sight via the shoulder abutment portion and the handle of the stock and via an upper portion of the actuatable portion and being actuatable to cause the optical sight to operate in the second mode.

9. The switch assembly according to claim 8, wherein the shoulder mounted device comprises a rifle and the optical sight is coupled to a rail disposed on an upper surface of the upper portion of the actuatable portion.

10. The switch assembly according to claim 9, wherein the switch is disposed in a recess defined in a rear of the stock and is actuatable by abutment with a user's shoulder.

11. The switch assembly according to claim 8, further comprising a battery to provide power to the electrically powered optical sight, wherein the optical sight comprises a resistive element and a light emitting diode (LED).

12. The switch assembly according to claim 8, wherein the switch comprises one of a mechanical switch and a Hall Effect sensor.

13. The switch assembly according to claim 1, further comprising circuitry which extends from the switch, through the shoulder abutment portion and the handle of the stock and through the upper portion of the actuatable portion and by which the switch and the optical sight are electrically coupled.

14. The switch assembly according to claim 13, wherein:

the circuitry runs through a channel defined through the shoulder abutment portion and the handle of the stock and through the upper portion of the actuatable portion, and the channel terminates in the upper portion of the actuatable portion.

15. A switch assembly for optical sight activation, comprising:

a shoulder mounted device comprising an actuatable portion and a stock having a handle and a shoulder abutment portion, the stock being formed to define a recess in the shoulder abutment portion and a channel defined through the shoulder abutment portion and the handle of the stock and through an upper portion of the actuatable portion, the channel terminating in the upper portion of the actuatable portion, and the stock being integrally coupled to a rear of the actuatable portion;

an electrically powered optical sight disposable on the shoulder mounted device in alignment with the actuatable portion, the optical sight being normally operable in a sleep mode and selectively operable in an active mode;

a switch disposed in the recess of the stock; and circuitry extending from the switch and running through the channel through the shoulder abutment portion and the handle of the stock and through the upper portion of the actuatable portion and by which the switch and the optical sight are electrically coupled, the switch being actuatable to cause the optical sight to operate in the second mode.

16. The switch assembly according to claim 15, wherein the shoulder mounted device comprises a rifle and the optical sight is coupled to a rail disposed on an upper surface of the actuatable portion.

17. The switch assembly according to claim 15, further comprising a battery to provide power to the electrically powered optical sight, wherein the optical sight comprises a resistive element and a light emitting diode (LED).

18. The switch assembly according to claim 15, wherein the switch comprises one of a mechanical switch and a Hall Effect sensor.

* * * * *